US009776401B2

(12) United States Patent
Murate

(10) Patent No.: US 9,776,401 B2
(45) Date of Patent: Oct. 3, 2017

(54) DROPLET EJECTION APPARATUS AND METHOD FOR EJECTING LIQUID DROPLET

(71) Applicant: Hirohito Murate, Kanagawa (JP)

(72) Inventor: Hirohito Murate, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/186,732

(22) Filed: Jun. 20, 2016

(65) Prior Publication Data

US 2016/0375684 A1 Dec. 29, 2016

(30) Foreign Application Priority Data

Jun. 26, 2015 (JP) ..... 2015-129271

(51) Int. Cl.
*B41J 2/045* (2006.01)
*B41J 2/14* (2006.01)

(52) U.S. Cl.
CPC ..... *B41J 2/04588* (2013.01); *B41J 2/0451* (2013.01); *B41J 2/04581* (2013.01); *B41J 2/04596* (2013.01); *B41J 2002/14354* (2013.01); *B41J 2202/20* (2013.01); *B41J 2202/21* (2013.01)

(58) Field of Classification Search
None
See application file for complete search history.

(56) References Cited

U.S. PATENT DOCUMENTS

| | | | | |
|---|---|---|---|---|
| 6,502,914 | B2 | 1/2003 | Hosono et al. | |
| 2001/0024214 | A1* | 9/2001 | Takahashi | B41J 2/04508 347/11 |
| 2003/0025744 | A1* | 2/2003 | Nou | B41J 2/0458 347/10 |
| 2015/0258780 | A1 | 9/2015 | Hayashi | |
| 2015/0352841 | A1 | 12/2015 | Horie | |
| 2015/0367633 | A1 | 12/2015 | Murate | |
| 2016/0107440 | A1 | 4/2016 | Kanzawa | |

FOREIGN PATENT DOCUMENTS

| | | |
|---|---|---|
| JP | H11-078013 | 3/1999 |
| JP | 2002-337333 | 11/2002 |
| JP | 2003-118107 | 4/2003 |
| JP | 2015-171807 | 10/2015 |

* cited by examiner

*Primary Examiner* — Lisa M Solomon
(74) *Attorney, Agent, or Firm* — IPUSA, PLLC

(57) ABSTRACT

A droplet ejection apparatus includes, a droplet ejection head, wherein the droplet ejection head includes a nozzle communicated with a pressure chamber, a first piezoelectric element configured to pressure liquid in the pressure chamber so as to cause a droplet to be ejected, and a second piezoelectric element capable of pressuring the liquid in the pressure chamber, a first drive waveform generation unit configured to generate a first drive waveform to be applied to the first piezoelectric element, a second drive waveform generation unit configured to generate a second drive waveform to be applied to the second piezoelectric element, and a control unit configured to apply the second drive waveform to the second piezoelectric element after the first piezoelectric element is driven due to the applied first drive waveform. Residual vibration of the liquid in the pressure chamber is suppressed by a vibration caused by the second piezoelectric element.

12 Claims, 12 Drawing Sheets

DROPLET EJECTION APPARATUS AND METHOD FOR EJECTING LIQUID DROPLET

BACKGROUND OF THE INVENTION

1. Field of the Invention

The present disclosure relates to droplet ejection apparatuses and methods for ejecting liquid droplet.

2. Description of the Related Art

For example, an inkjet recording apparatus is known as an image forming apparatus including a printer, a fax machine, a copy machine, and a multifunction peripheral. The inkjet recording apparatus forms a desired image on a recording medium such as a paper sheet and a film for OHP (overhead projector) by ejecting droplets from an inkjet recording head.

As the inkjet recording head, so called piezoelectric type recording head is known, in which a piezoelectric element is used for pressuring ink in an ink flow channel. A vibration plate forming wall of the ink flow channel is vibrated with the piezoelectric element so as to change a volume inside the ink flow channel, thereby ejecting the ink droplets.

Recently, operation speed of the inkjet recording apparatus using the recording head as described above is improved. Also, a line-scanning-type inkjet recording apparatus, with which high speed operation can be achieved, is proposed. There are line scanning inkjet type recording apparatuses including a continuous inkjet recording heads and line scanning inkjet recording apparatuses including on-demand inkjet recording heads. The operation speed of the inkjet recording apparatus including the on-demand inkjet recording head (e.g., Japanese Unexamined Patent Application Publication No. H11-78013) is lower in comparison to the inkjet recording apparatus including the continuous inkjet recording head. However, the inkjet recording apparatus including the on-demand inkjet recording head is preferable for widely distributed high speed recording apparatus because the ink system can be made simple.

When drive frequency of the recording head is increased in order to achieve the high speed operation of the recording apparatus, an interval of droplet ejection decreases. In this case, a droplet ejection operation starts before a meniscus vibration caused by a preceding droplet ejection operation decays sufficiently, because of the decreased interval of droplet ejection. Therefore, impact positions of droplets and amounts of ink in a droplet may disperse to cause a degradation of image quality such as inclined ejection and variation in the density of ink.

Hence, the meniscus needs to be made stable in order to perform a high quality image forming. For example, as illustrated in FIG. 15, a method for stabilizing the meniscus is known, in which a control waveform for suppressing residual vibration is included in a head drive waveform for ejecting the ink droplet (Japanese Unexamined Patent Application Publication No. 2002-337333).

FIG. 15 is a diagram illustrating a head drive waveform including a waveform for ejecting the ink droplet from the head and a waveform for stabilizing the meniscus on a nozzle surface after ejection of the ink droplet. In FIG. 15, P1 to P5 are ejection pulses for ejecting the ink droplet while P6 is a vibration control waveform for stabilizing the meniscus.

However, in a case where the vibration control waveform is included in the head drive waveform, a total length of the head drive waveform becomes long. Therefore, upper limit frequency of head drive operation decreases, and high speed image forming operation becomes difficult in such a state.

RELATED ART DOCUMENT

Patent Document

[Patent Document 1]: Japanese Unexamined Patent Application Publication No. H11-78013

[Patent Document 2]: Japanese Unexamined Patent Application Publication No. 2002-337333

SUMMARY OF THE INVENTION

An object of the present disclosure is to provide a droplet ejection apparatus in which the meniscus vibration is suppressed without increasing a length of a head drive waveform.

The following configuration is adopted to achieve the aforementioned object.

In one aspect of the embodiment of the present disclosure, there is provided a droplet ejection apparatus includes, a droplet ejection head, wherein the droplet ejection head includes a nozzle communicated with a pressure chamber, a first piezoelectric element configured to pressure liquid in the pressure chamber so as to cause a droplet to be ejected, and a second piezoelectric element capable of pressuring the liquid in the pressure chamber, a first drive waveform generation unit configured to generate a first drive waveform to be applied to the first piezoelectric element, a second drive waveform generation unit configured to generate a second drive waveform to be applied to the second piezoelectric element, and a control unit configured to apply the second drive waveform to the second piezoelectric element after the first piezoelectric element is driven due to the applied first drive waveform. A residual vibration of the liquid in the pressure chamber is suppressed by a vibration caused by the second piezoelectric element driven in accordance with the second drive waveform, the residual vibration being caused by the first piezoelectric element driven in accordance with the first drive waveform.

Other objects, features, and advantages of the present disclosure will become apparent from the following detailed description when read in conjunction with the accompanying drawings.

DETAILED DESCRIPTION OF THE PREFERRED EMBODIMENTS

Figure 1:
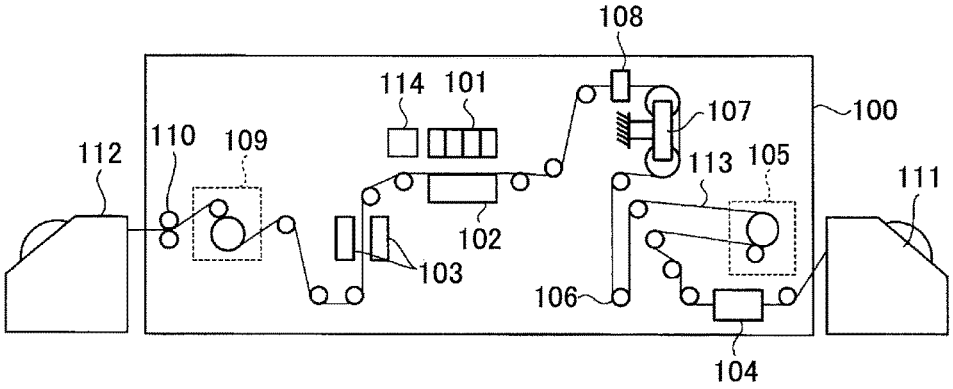
FIG. 1 is a diagram schematically illustrating an example inkjet recording apparatus of the first embodiment.

In the following, embodiments of present disclosure are described with reference to accompanying drawings. Additionally, in respective drawings, identical reference numerals will be applied to an elements or the like that have substantially similar functions and configurations to those in another drawing, and descriptions thereof may be omitted.

<Inkjet Recording Apparatus>

FIG. 1 is a diagram schematically illustrating an example on-demand-type and line-scanning-type inkjet recording apparatus.

As illustrated in FIG. 1, the inkjet recording apparatus 100 is disposed between a recording media feeding unit 111 and a recording media retrieving unit 112. The recording apparatus 100 includes a recording unit 101, a platen 102 facing the recording unit 101, a drying unit 103, a maintenance and restoration unit 114, a recording media conveyance unit, and the like.

A continuous recording medium (also referred to rolled paper, continuous paper, etc.) 113 is fed from the recording media feeding unit 111 at a high speed and wound and retrieved by the recording media retrieving unit 112.

The recording unit 101 includes an inkjet recording head in which nozzles (print nozzles) are arranged across an entire print width. A color print is performed with respective colors of inkjet recording heads, which are black, cyan, magenta, and yellow. Nozzle surfaces of respective inkjet recording heads are supported on the platen 102, where a predetermined interval is provided between the inkjet recording heads. The recording unit 101 forms a color image on a print surface of the recording medium 113 by performing ink droplet ejection in synchronization with conveyance speed of the recording media conveyance unit. The drying unit 103 dries and fixes the ink ejected on the recording medium 113 so as to prevent the ink from adhering to another portion. A contactless-type drying device may be used for the drying unit 103, or a contact-type drying device may be used.

The maintenance and restoration unit 114 performs appropriate maintenance and restoration operations on an inkjet recording head module included in the inkjet recording apparatus 100 so as to recover a performance of the inkjet recording head.

The recording media conveyance unit includes a regulating guide 104, an infeed unit 105, a dancer roller 106, a EPC (Edge Position Control) 107, a meandering amount detector 108, an outfeed unit 109, a puller 110, and the like.

The regulating guide 104 positions the recording medium 113 fed from the recording media feeding unit 111, in width direction. The infeed unit 105 is formed by a driven roller and a drive roller, and keeps a tension applied to the recording medium 113 to be constant. The dancer roller 106 moves upward and downward according to the tension of the recording medium 113, and outputs a position signal. The EPC 107 controls meandering of the recording medium 113. The meandering amount detector 108 is used to feed back the meandering amount. The outfeed unit 109 is formed by a driven roller and a drive roller, and rotates at a constant rotational speed so as to convey the recording medium 113 at a set conveyance speed. The puller 110 is formed by the driven roller and a drive roller, and ejects the recording medium 113 outside the apparatus. The recording media conveyance apparatus is a tension-control-type conveyance apparatus that keeps the tension of the conveyed recording medium 113 to be constant by detecting a position of the dancer roller 106 to control rotation of the infeed unit 105.

<Inkjet Recording Head Module>

Figure 2:
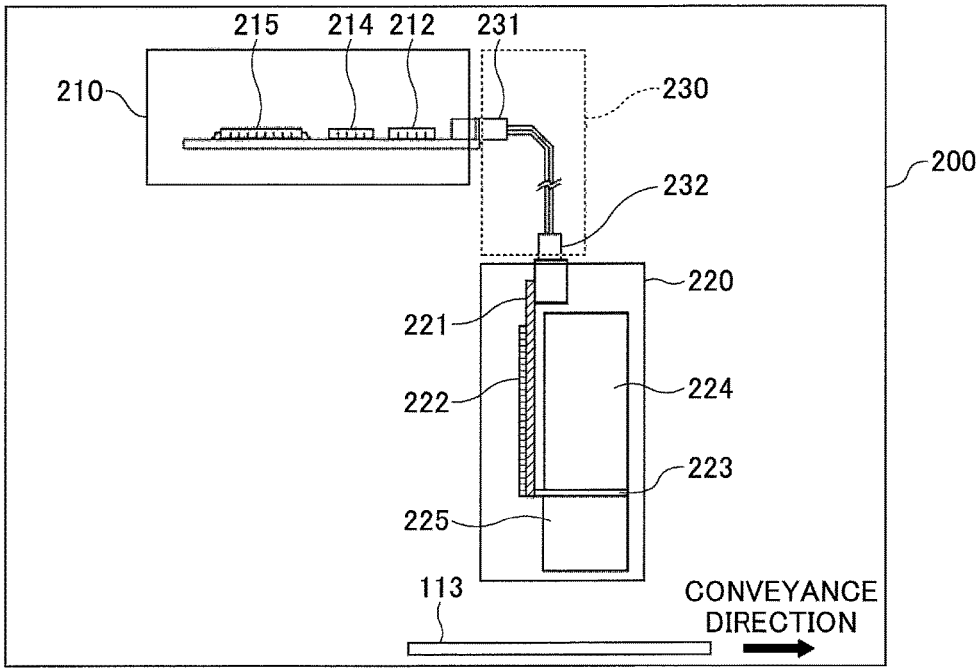
FIG. 2 is a schematic side view of the inkjet recording head module included in the inkjet recording apparatus.

FIG. 2 is a schematic side view of the inkjet recording head module included in the inkjet recording apparatus 100.

As illustrated in FIG. 2, the inkjet recording head module (droplet ejection device) 200 includes a drive control substrate 210, an inkjet recording head 220, cables 230, and the like.

A first drive waveform generation unit 212, a second drive waveform generation unit 214, a control unit 215, etc., are mounted on the drive control substrate 210. The inkjet recording head 220 includes a head substrate 221, a residual vibration detection substrate 222, a head drive IC substrate 223, an ink tank 224, a rigid plate 225, and the like. The cables 230 are connecting a drive control substrate side connector 231 and a head side connector 232. Analog communication and digital communication between the drive control substrate 210 and the head substrate 221 are performed via the cable 230.

In the line-scanning-type inkjet recording apparatus 100, one or more inkjet recording heads 220 are arranged in a direction perpendicular to a conveyance direction of the recording medium 113. A high speed image forming can be achieved by ejecting ink droplets from the line-scanning-type inkjet recording head 220 to the recording medium 113. Additionally, a droplet ejection apparatus of the present embodiment may be applied to a serial-scanning-type inkjet recording apparatus in which one or more inkjet recording heads are moved in a direction orthogonal to the conveyance direction of the recording medium 113.

<Inkjet Recording Head>

Figure 3:
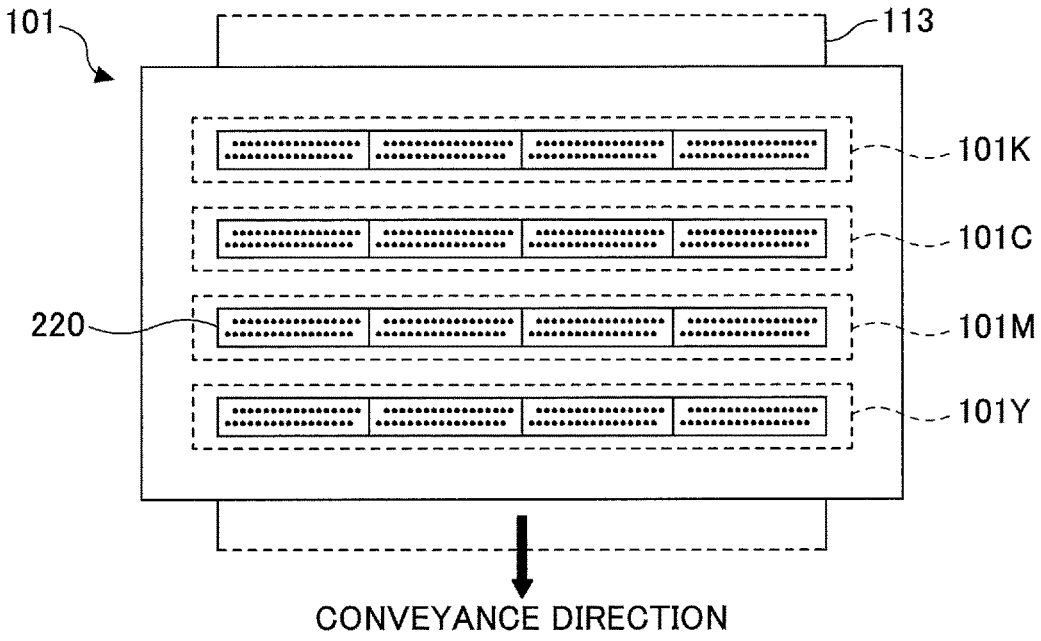
FIG. 3 is an enlarged plane view of an example head unit of a recording unit included in the inkjet recording apparatus.

FIG. 3 is an enlarged plane view of an example head unit of the recording unit 101 included in the inkjet recording apparatus 100.

The recording unit 101 includes a black head array 101K, a cyan head array 101C, a magenta head array 101M, and a yellow head array 101Y, where a plurality of inkjet recording heads 220 are included in the head arrays of respective colors. The black head array 101K ejects black ink droplets, a cyan head array 1010 ejects cyan ink droplets, a magenta head array 101M ejects magenta ink droplets, and a yellow head array 101Y ejects magenta ink droplets.

The head arrays 101K, 101C, 101M and 101Y of respective colors are arranged in a direction parallel to the conveyance direction of the recording medium 113. A plurality of inkjet recording heads 220 are arranged in a direction orthogonal to the conveyance direction of the recording medium 113. When the plurality of inkjet recording heads 220 are arranged in an array form, a width of print area can be made wider.

Figure 4:
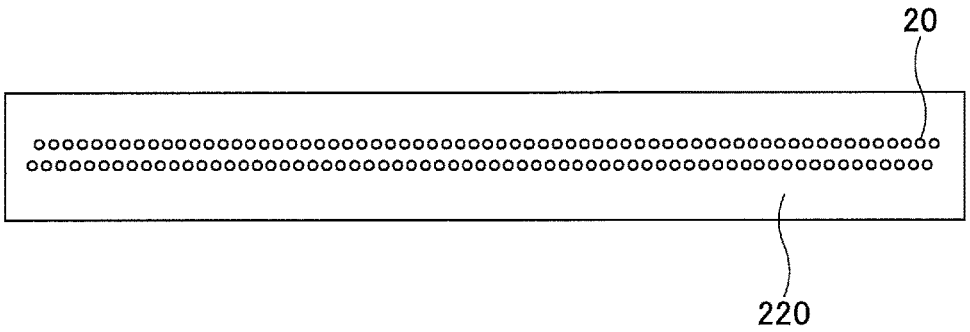
FIG. 4 is an enlarged bottom view of an inkjet recording head of the first embodiment.

FIG. 4 is an enlarged bottom view of the inkjet recording head 220 of the head unit. The inkjet recording head 220 includes a plurality of nozzles 20 arranged in a direction orthogonal to the conveyance direction of the recording medium 113, where the nozzles 20 are arranged in staggered manner. When arrangement of the nozzles is staggered, resolution of a print area may be increased.

Additionally, in the present embodiment, four inkjet recording heads 220 are arranged in every line, and thirty two nozzles 20 are arranged in every inkjet recording head, where two lines of nozzles 20 are staggered. However, this is not a limiting example, and number of lines and number of elements in a line may be different from this example.

In this way, the long inkjet recording head extending in a width direction of a sheet (recording medium 113) is used in the line-scanning-type recording unit, where nozzle holes (nozzles 20) for ejecting ink particles are arranged in lines extending in the width direction of the sheet. The recording head facing to the recording medium ejects the ink particles while the recording medium is continuously moved so as to perform a scanning operation. Recording dots (dots of ink-jet print) are selectively formed on a scanning line in a scanning direction, thereby forming an image on the sheet to which the respective nozzles face.

Figure 5:
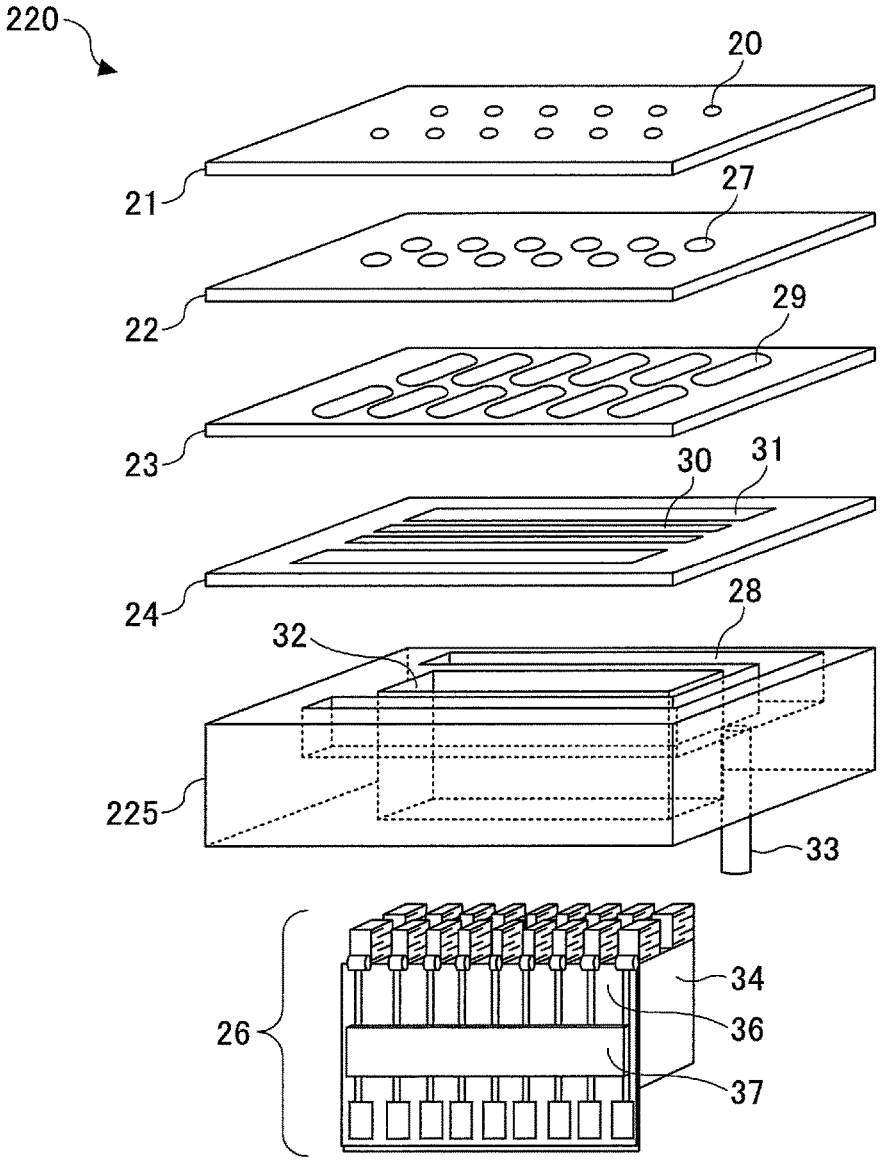
FIG. 5 is an example perspective view of the inkjet recording head.

FIG. 5 is an example perspective view of the inkjet recording head 220 included in the inkjet recording apparatus 100.

Figure 6:
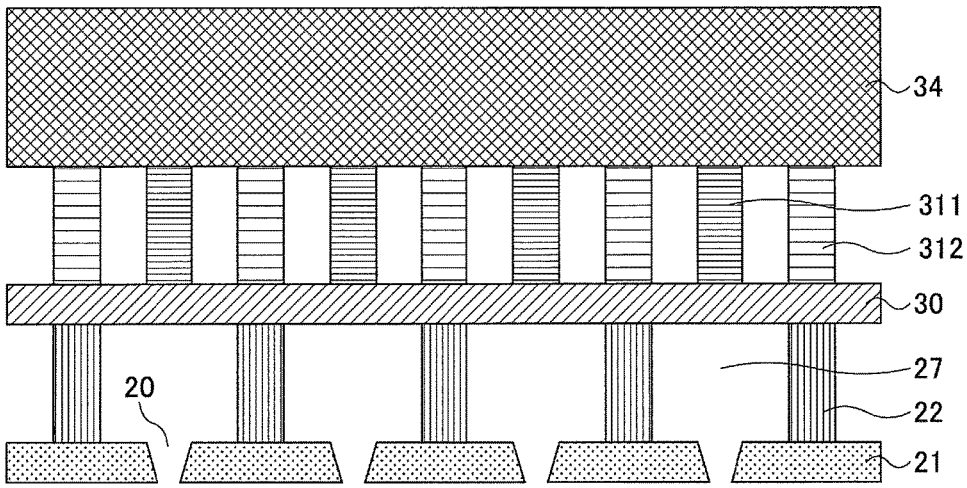
FIG. 6 is an example schematic cross-sectional view of the inkjet recording head.

As illustrated in FIG. 5, the inkjet recording head 220 includes a nozzle plate 21, a pressure chamber plate 22, restrictor plate 23, a diaphragm plate 24, a rigid plate 225, a group of piezoelectric elements 26, and the like. The group of piezoelectric elements 26 includes a support member 34, a plurality of piezoelectric elements 311 and a plurality of piezoelectric elements 312, a piezoelectric elements connecting substrate 36, a piezoelectric element drive IC 37, and the like, A plurality of nozzles 20 are formed in the nozzle plate 21. In pressure chamber plate 22, pressure chambers 27 corresponding to respective nozzles 20 are formed, where portions of the pressure chamber plate 22 at which the pressure chambers 27 are not formed serve as partition walls for separating a plurality of pressure chambers 27 as illustrated in FIG. 6. Restrictors 29 for controlling flow amount of the ink to the pressure chamber 27 is formed in the restrictor plate 23, where the restrictor 29 connects the pressure chamber 27 and a common ink flow passage 28. In the diaphragm plate 24, vibration plates (elastic walls) 30 and filters 31 are formed.

The nozzle plate 21, the pressure chamber plate 22, the restrictor plate 23, and the diaphragm plate 24 are stacked in the order, and a positioning operation is performed, thereby forming a flow passage plate. Additionally, the nozzle plate 21, the pressure chamber plate 22, the restrictor plate 23, and the diaphragm plate 24 are located under the rigid plate 225 illustrated in FIG. 2. The flow passage plate is coupled to the rigid plate 225, the filter 31 faces an opening 32 of the common ink flow passage 28, and the group of piezoelectric elements 26 is inserted in the opening 32. An upper open end of ink introduction pipe 33 is coupled to the common ink flow passage 28, while a lower open end of ink introduction pipe 33 is coupled to a head tank in which the ink is kept.

The piezoelectric elements 311 and the piezoelectric elements 312 are formed on a surface of the support member 34, free ends of the piezoelectric elements 311 and the piezoelectric elements 312 are adhered to the vibration plate 30 and fixed. The piezoelectric element drive IC 37 is formed on a surface of the piezoelectric elements connecting substrate 36, and the piezoelectric elements 311 and the piezoelectric elements 312 are electrically connected with the piezoelectric elements connecting substrate 36. The piezoelectric elements 311 are controlled by the piezoelectric element drive IC 37 based on a drive waveform (e.g., drive voltage waveform) generated by drive waveform generation units 212 and 214 (see FIG. 10). The piezoelectric element drive IC 37 is controlled based on image data transmitted from a higher order controller, a timing signal output from the control unit 215, and the like.

Additionally, in FIG. 5, numbers of the nozzles 20, the pressure chambers 27, the restrictors 29, the piezoelectric elements 311, the piezoelectric elements 312 are less than an actual configuration, for the convenience of illustration.

FIG. 6 is an example schematic cross-sectional view of the inkjet recording head 220 of the present embodiment.

As illustrated in FIG. 6, drive piezoelectric elements 311 that are first piezoelectric elements and support piezoelectric elements 312 that are second piezoelectric elements are included in the piezoelectric elements, where the drive piezoelectric element 311 and the support piezoelectric element 312 are alternately disposed. The drive piezoelectric elements 311 are formed at a portion corresponding to the opening of the pressure chamber 27 via the vibration plate 30. The support piezoelectric elements 312 are formed at a portion corresponding to the partition wall (pressure chamber plate 22) for separating the pressure chambers 27, where the vibration plate 30 is inserted between the partition wall and the support piezoelectric element 312.

According to the configuration described above, characteristics variance is unlikely to occur even if positional displacement occurs in coupling the piezoelectric element to the vibration plate. Also, ejection characteristic of the inkjet recording head can be made stable by using the support piezoelectric element 312 for controlling the meniscus.

<Residual Vibration Control>

Figure 7A:
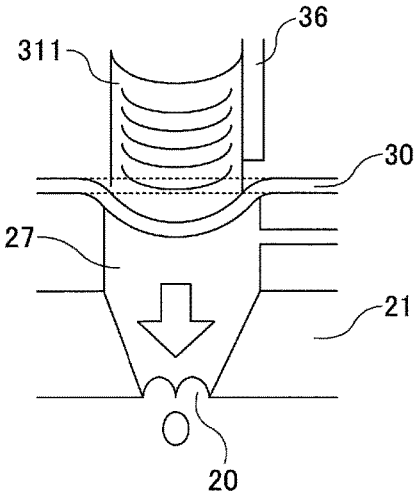
FIG. 7A is a diagram schematically illustrating ink ejection operation and residual vibration.
Figure 7B:
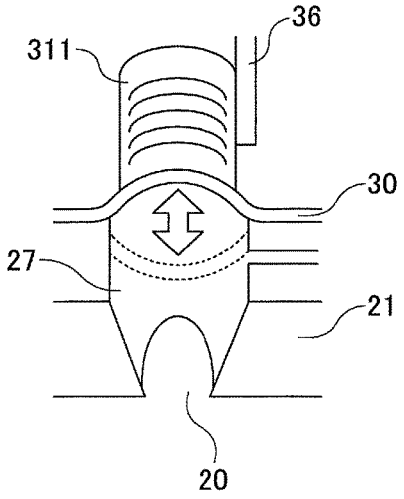
FIG. 7B is another diagram schematically illustrating ink ejection operation and residual vibration.

FIG. 7A and FIG. 7B are a diagrams schematically illustrating residual vibration in the pressure chamber of the inkjet recording head 220. FIG. 7A illustrates a state during the ink droplet ejection. FIG. 7B illustrates a state after the ink droplet ejection. Variance of pressure in the pressure chamber is schematically illustrated by both diagrams.

Figure 8:
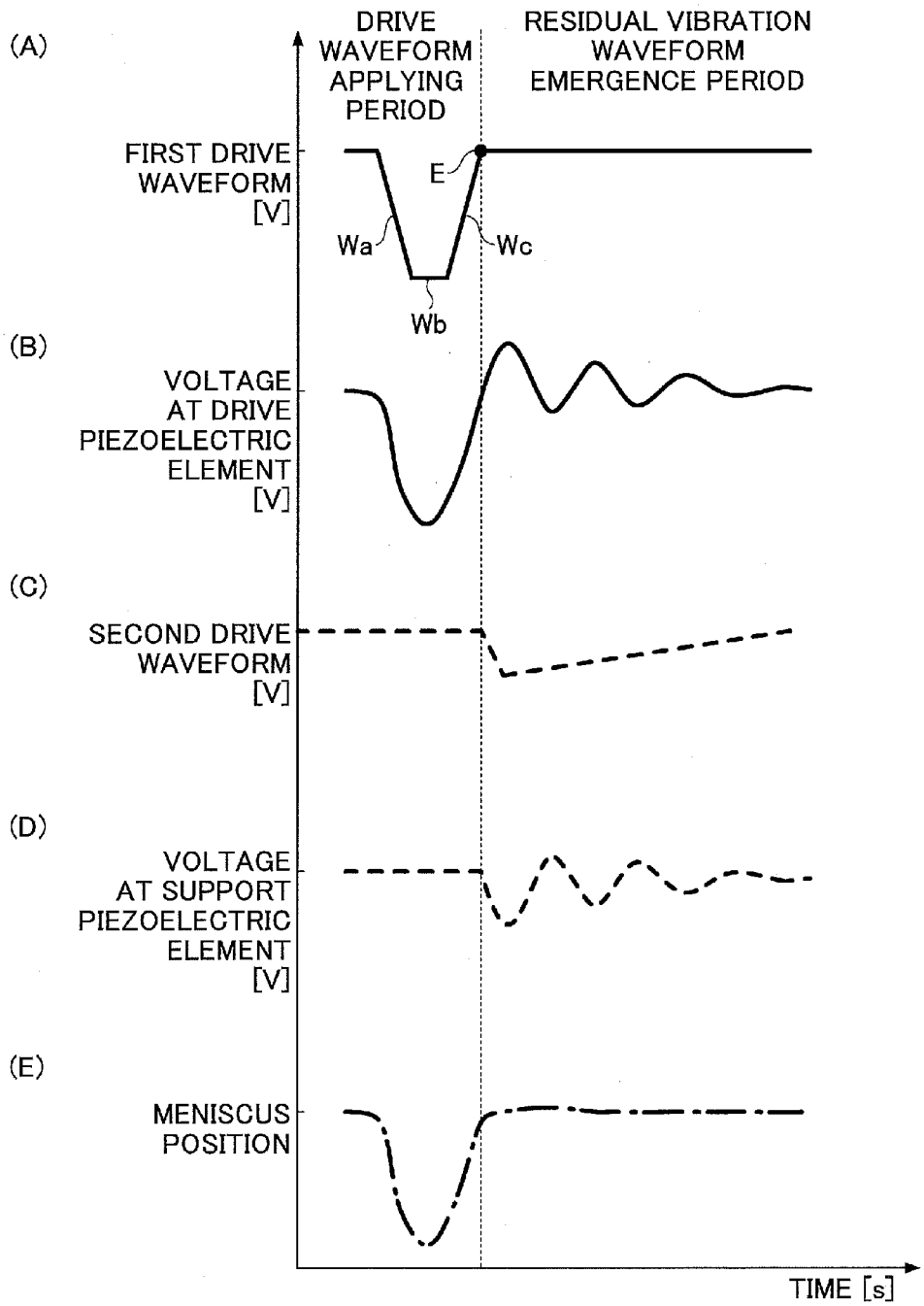
FIG. 8 is a diagram illustrating a drive waveform in a drive waveform applying period and in a residual vibration waveform emergence period, etc., in an example first control.

FIG. 8 is a diagram illustrating the drive waveform in a drive waveform applying period and in a residual vibration waveform emergence period, the voltage at the piezoelectric element, and the meniscus of the ink. In FIG. 8, lateral axis indicates time (s), while longitudinal axis indicates voltage (V). The drive waveform applying period corresponds to FIG. 7A, while the residual vibration waveform emergence period corresponds to FIG. 7B.

As illustrated in FIG. 7A, upon the drive wave form generated by the first drive waveform generation unit 212 being applied to the drive piezoelectric element 311 (more specifically, an electrode of piezoelectric elements connecting substrate 36), the drive piezoelectric element 311 expands and contracts. When expansion/contraction force generated by the drive piezoelectric element 311 is applied to the ink in the pressure chamber 27 via the vibration plate 30 to vary the pressure in the pressure chamber 27, the ink droplet is ejected from the nozzle 20.

As illustrated in FIG. 7A and portion (A) of FIG. 8 (FIG. 8 (A)), when the first drive waveform falls down (waveform element Wa), the drive piezoelectric element 311 is contracted to expand the pressure chamber 27, and the pressure in the pressure chamber 27 is reduced. Also, when the first drive wave form rises up (waveform element Wc), the drive piezoelectric element 311 is expanded to contract the pressure chamber 27, and the pressure in the pressure chamber 27 is increased.

As illustrated in FIG. 7B, a residual pressure vibration due to repeated expansion and contraction of the ink occurs in the pressure chamber 27 after the drive waveform is applied to the drive piezoelectric element 311 (after ink droplet ejection). The residual pressure wave is transmitted from the ink in the pressure chamber 27 to the drive piezoelectric element 311 via the vibration plate 30. The residual vibration caused by the residual pressure wave decays to form a waveform of damped vibration.

When the next ejection operation starts before the meniscus vibration caused by the residual vibration decays enough, ejection speed of the next droplet varies due to the residual vibration. Thus, impact positions of droplets and amounts of ink in a droplet may disperse to cause a degradation of image quality such as inclined ejection and variation in the density of ink.

<First Example Control>

In the first example control of the embodiment of the present disclosure, the second drive waveform is applied to the support piezoelectric element 312 as illustrated in FIG. 8 (C).

The second drive waveform is applied to the support piezoelectric element 312 at a timing corresponding to the end of the waveform element Wc. In the example illustrated in FIG. 8 (C), at timing corresponding to the end "E" of the waveform element Wc, the second drive waveform is applied to the second piezoelectric element so as to suppress the contraction firstly caused in the residual vibration, where the support piezoelectric element 312 contracts and the pressure chamber 27 expands with the applied second drive waveform.

Additionally, the drive waveform applied to the support piezoelectric element needs to work for the first (primary) contraction in the residual vibration. Therefore, the voltage of the drive waveform applied to the support piezoelectric element needs to be returned to a predetermined value before a timing at which the next first drive waveform is finished to be applied to the drive piezoelectric element.

When the second drive waveform is applied to the support piezoelectric element as illustrated in FIG. 8 (C), the voltage of the support piezoelectric element 312 varies as illustrated in FIG. 8 (D). The voltage at the support piezoelectric element 312 vibrates in an inverse phase to the phase of the residual vibration in the pressure chamber caused by the first piezoelectric element driven by waveform illustrated in FIG. 8 (B).

Therefore, the residual vibration of the first piezoelectric element 311 and the vibration of the second piezoelectric element 312 in the inverse phase to the phase of the residual vibration are offset each other. Hence, as illustrated in FIG. 8 (E), meniscus position of the ink is stabilized.

Additionally, the above described control, in which the second drive waveform is applied so as to generate the vibration of the support piezoelectric element in the inverse phase to the phase of the residual vibration, is preferable for an inkjet recording head having a rigidity and a configuration in which the drive piezoelectric element 311 and the support piezoelectric element 312 vibrate in the same phase.

However, the vibration of the support piezoelectric element 312 for making the meniscus stable is not limited to inverse phases.

In a case where the vibration of the drive piezoelectric element 311 has the inverse phase to the phase of the support piezoelectric element 312, the residual vibration can be suppressed by applying the drive waveform so as to generate the vibration in the same phase. An example control of this case is described with reference to FIG. 9.

<Example Second Control>

In the example second control of the embodiment of the present disclosure, the second drive waveform is applied to the support piezoelectric element (second piezoelectric element) at a timing corresponding to the end of the waveform element Wc. In the example illustrated in FIG. 9 (C), at timing corresponding to the end "E" of the waveform element Wc, the second drive waveform is applied to the second piezoelectric element so as to suppress the contraction firstly caused in the residual vibration, where the support piezoelectric element 312 expands and the pressure chamber 27 contracts with the applied second drive waveform.

Additionally, the drive waveform applied to the support piezoelectric element needs to work for the first (primary) contraction in the residual vibration. Therefore, the voltage of the drive waveform applied to the support piezoelectric element needs to be returned to a predetermined value before a timing at which the next first drive waveform is finished to be applied to the drive piezoelectric element.

Figure 9:
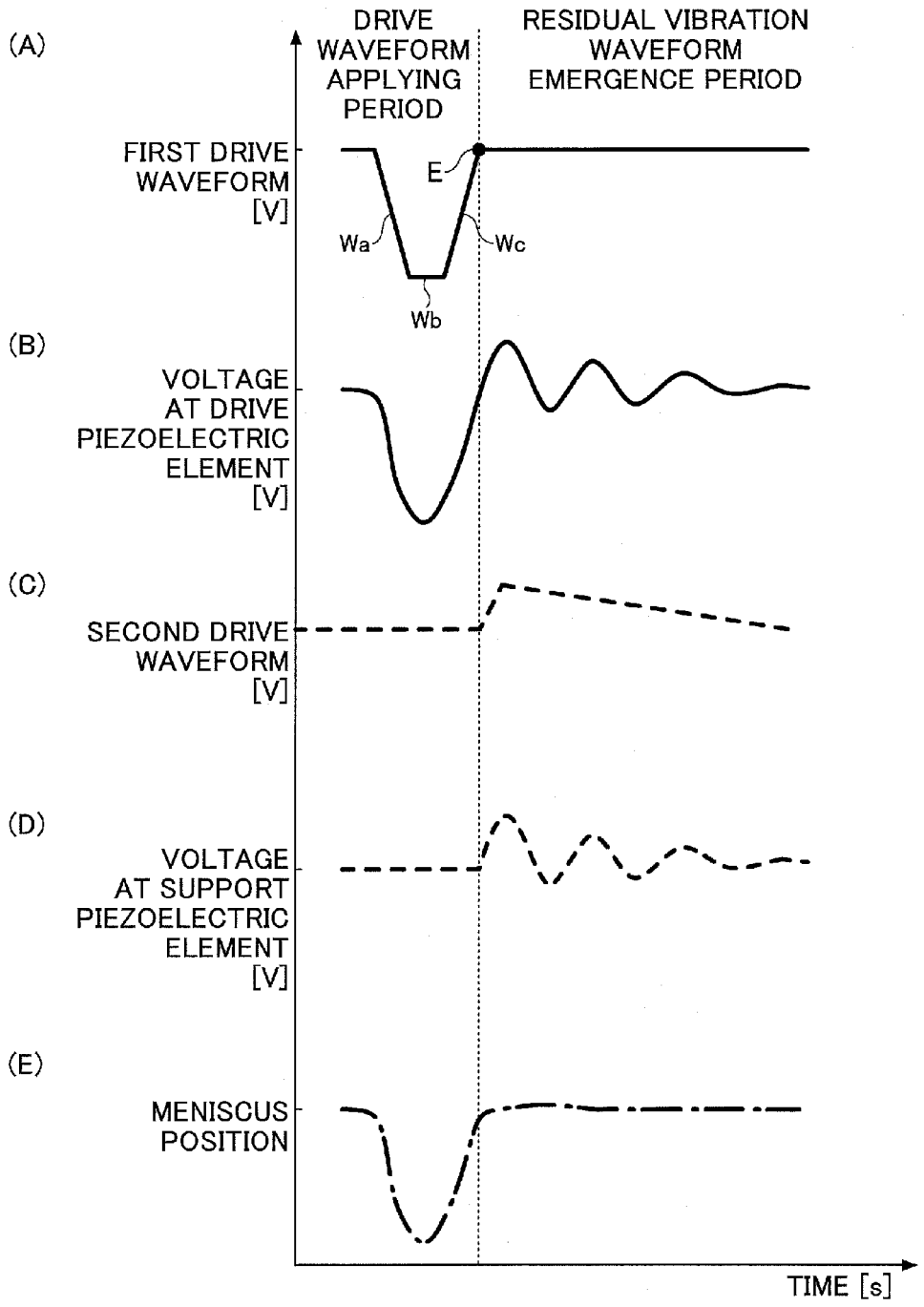
FIG. 9 is a diagram illustrating a drive waveform in a drive waveform applying period and in a residual vibration waveform emergence period, etc., in an example second control.

When the second drive waveform is applied to the support piezoelectric element as illustrated in FIG. 9 (C), the voltage of the support piezoelectric element 312 varies as illustrated in FIG. 9 (D). The voltage of the support piezoelectric element 312 vibrates in an inverse phase to the phase of the residual vibration in the pressure chamber caused by the first piezoelectric element driven by waveform illustrated in FIG. 9 (B).

Therefore, the residual vibration of the first piezoelectric element 311 and the vibration of the second piezoelectric element 312 in the same phase to the phase of the residual vibration are offset each other because the example second control is applied to an inkjet recording head having a rigidity and a configuration in which the drive piezoelectric element 311 vibrates in the inverse phase to the phase of vibration of the support piezoelectric element 312. Hence, as illustrated in FIG. 9 (E), meniscus position of the ink is stabilized.

Here, the residual vibration in the pressure chamber (separate liquid chamber) 27 can be more precisely suppressed by driving one or both support piezoelectric elements 312 adjacent to the drive piezoelectric element 311 (see FIG. 6) as described with reference to FIG. 8.

Also, in this example, although the support piezoelectric element is vibrated so as to suppress the residual vibration of the ink meniscus in the pressure chamber 27, this is not a limiting example. The piezoelectric element (second piezoelectric element) for vibrating the pressure chamber may be something other than the support piezoelectric element, except the drive piezoelectric element, and may be disposed in a different portion.

<Configuration of Drive Unit>

Figure 10:
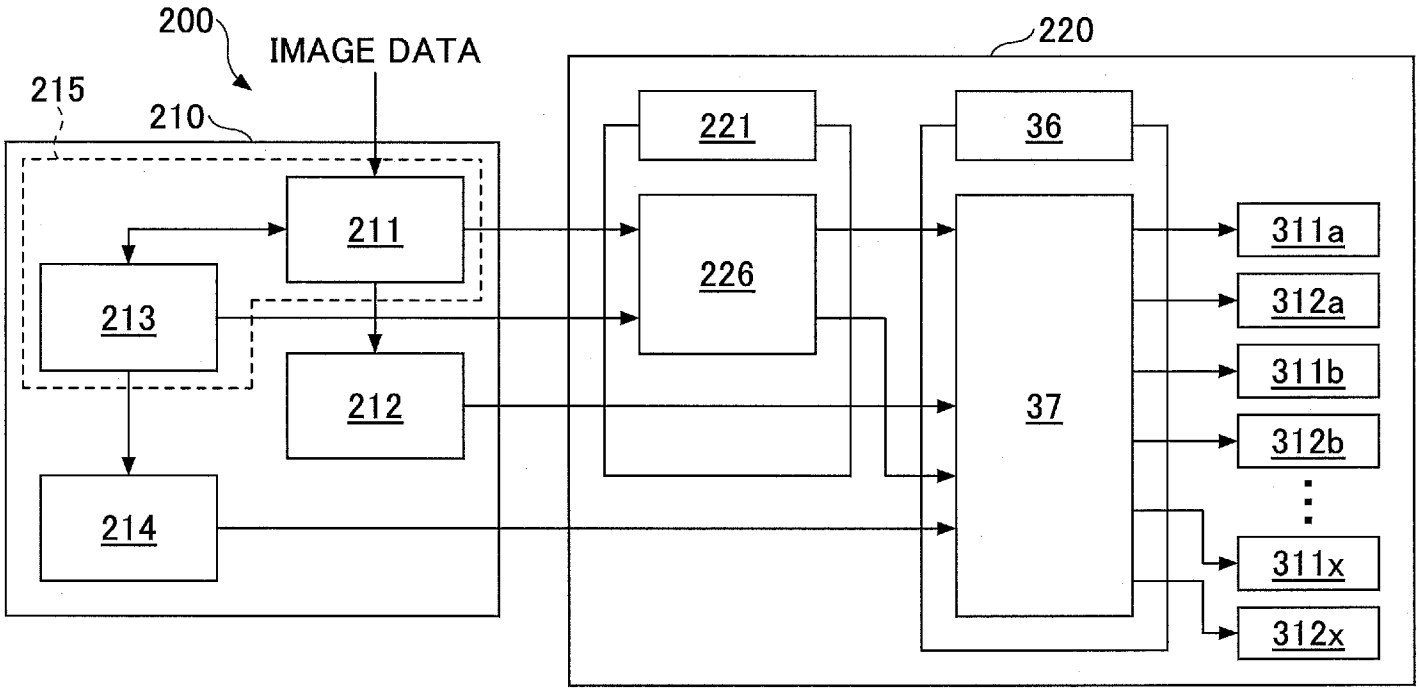
FIG. 10 is a block diagram illustrating an example inkjet recording head module of the first embodiment.

FIG. 10 is a block diagram illustrating an example droplet ejection head module 200 of the first embodiment of the present disclosure. In FIG. 10, the inkjet recording head module 200 includes the drive control substrate 210 and the inkjet recording head 220.

The drive control substrate 210 includes the control unit 215, the first drive waveform generation unit (drive waveform generation unit) 212, and the second drive waveform generation unit (support piezoelectric element drive waveform generation unit) 214. The control unit 215 includes a first drive control unit (drive control unit) 211 and a second drive control unit (support piezoelectric element drive control unit) 213.

The inkjet recording head 220 includes the head substrate 221, a piezoelectric element supporting substrate 38, piezoelectric elements 311*a*-311*x*, and piezoelectric elements 312*a*-312*x* as the drive unit.

In the drive control substrate 210, the first drive control unit 211 generates a timing control signal based on image data and drive waveform data for driving the drive piezoelectric element 311. The first drive waveform generation unit 212 performs D/A conversion on the generated drive waveform data, and further preforms voltage amplification and current amplification on the conversion result.

The second drive control unit 213 generates a timing control signal for controlling drive timing of the support piezoelectric element 312 and drive waveform data for driving the support piezoelectric element 312. The second drive waveform generation unit 214 performs D/A conversion on the generated drive waveform data, and further preforms voltage amplification and current amplification on the conversion result.

The digital signal such as the timing control signal generated by the drive waveform generation units of the first drive control unit 211 and the second drive control unit 213 included in the drive control substrate 210 are transmitted to the inkjet recording head 220 through a serial communication interface. The transmitted digital signal is deserialized by a control unit 226 of the head substrate 221, and input to the piezoelectric element drive IC 37.

The drive waveform generated by the first drive waveform generation unit 212 is input to the drive piezoelectric element 311 through on/off operation of the piezoelectric element drive IC 37 in accordance with the timing control signal. Similarly, the drive waveform generated by the second drive waveform generation unit 214 is input to the support piezoelectric element 312 through on/off operation of the piezoelectric element drive IC 37 in accordance with the timing control signal.

Additionally, in the control unit 215, the first drive control unit 211 and the second drive control unit 213 are connected with each other. The first drive control unit 211 and the second drive control unit 213 control the timing for applying the second drive waveform to the support piezoelectric element 312 so that the second drive waveform is applied at a timing when the first drive waveform is finished to be applied to the drive piezoelectric element 311 (see FIG. 8 (A), FIG. 8 (C), FIG. 9 (A), and FIG. 9 (C)).

Figure 11:
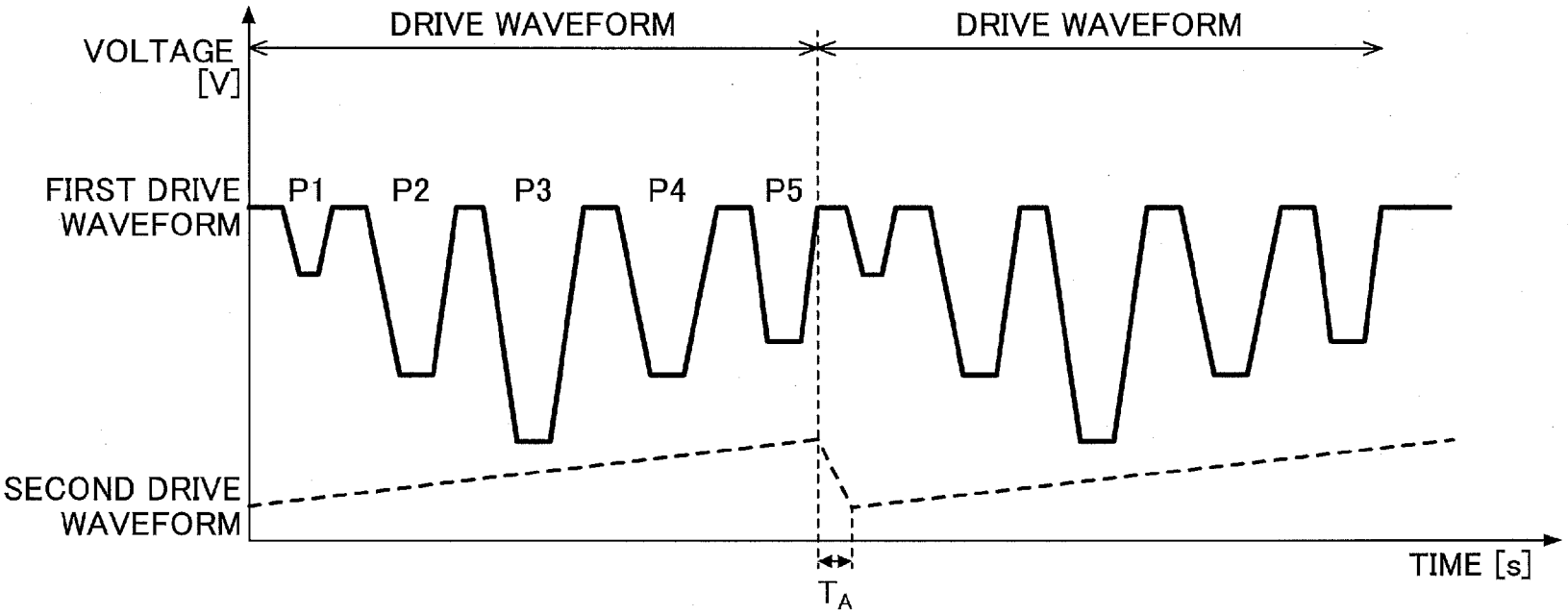
FIG. 11 is a diagram illustrating an example drive waveform of the first embodiment in continuous droplet ejection.

FIG. 11 is a diagram illustrating an example drive waveform of the first embodiment of the present disclosure in continuous droplet ejection.

In FIG. 11, the drive waveform for generating the vibration having the inverse phase to the phase of the residual vibration is applied to the support piezoelectric element just after a pulse P5. Therefore, the meniscus in the pressure chamber 27 is made stable in a period $T_A$.

Figure 15:
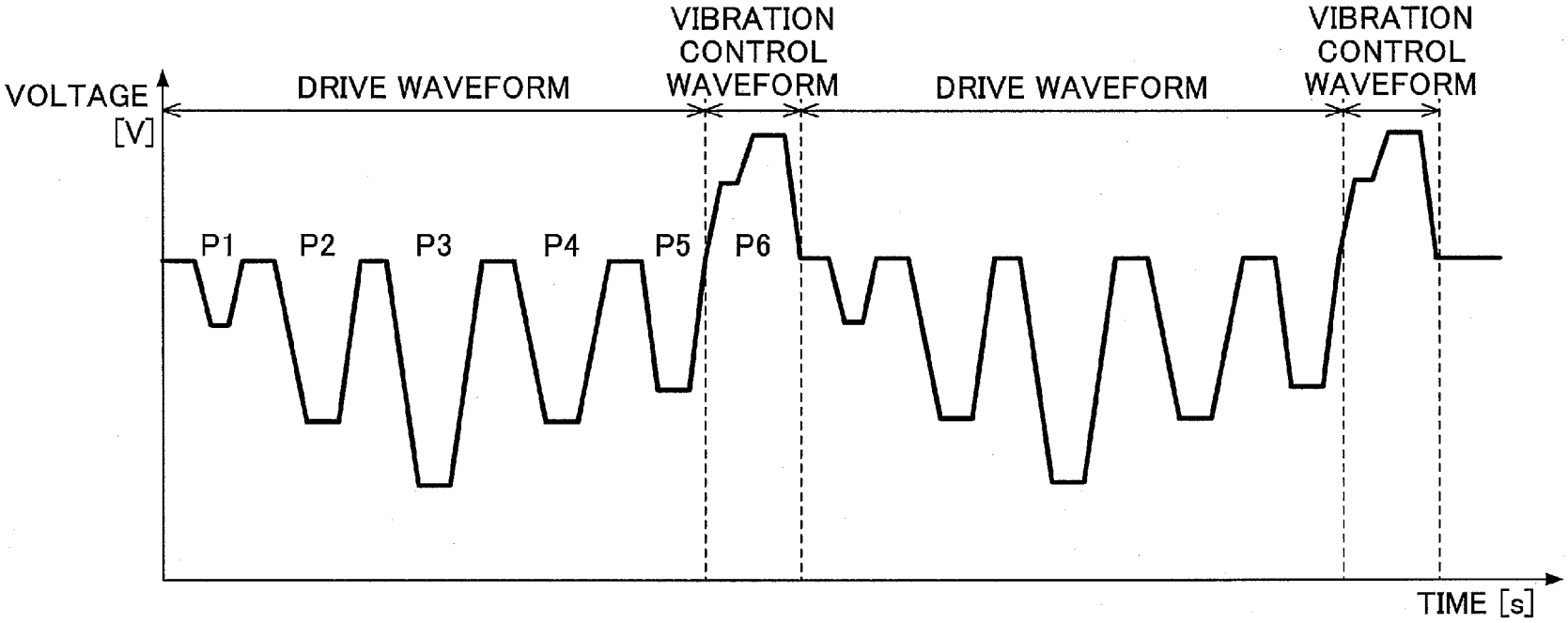
FIG. 15 is a diagram illustrating another drive waveform for comparison.

In this way, according to the control described above, the length of vibration control waveform, which is depicted as P6 in FIG. 15, is not required because the vibration control waveform is not included in the head drive waveform. Therefore, the length of drive waveform can be reduced by an amount corresponding to the vibration control waveform, thereby driving the inkjet recording head 220 at a high frequency. However, the illustrated drive waveform and the vibration control waveform are not limiting examples. Also, generation of the vibration having the inverse phase to the phase of the residual vibration may be performed in a period other than the period $T_A$.

Second Embodiment

Figure 12:
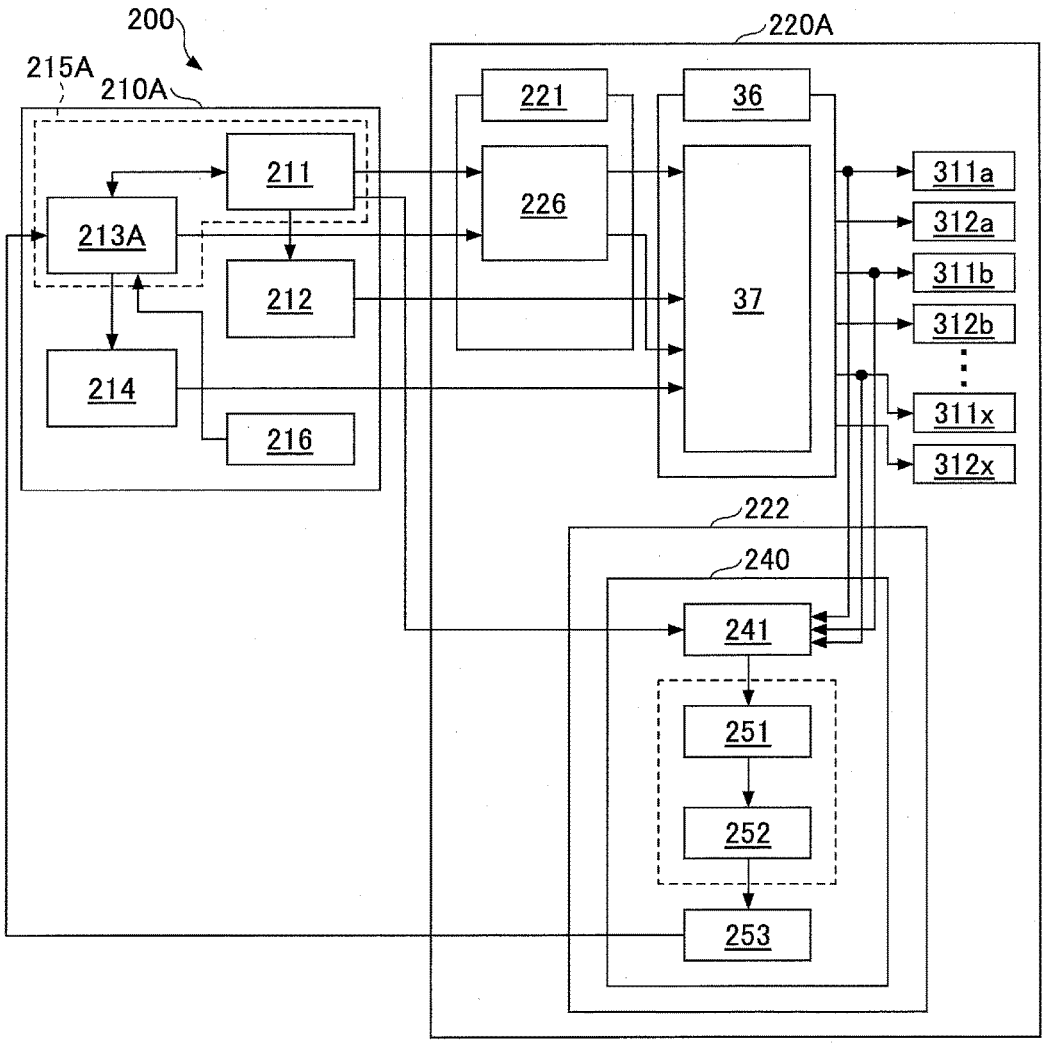
FIG. 12 is a block diagram illustrating an example droplet ejection head module of the second embodiment.

FIG. 12 is a block diagram illustrating an example droplet ejection head module 200A of the second embodiment. In FIG. 12, the droplet ejection head module 200A includes a drive control substrate 210A and a droplet ejection head 220A.

As illustrated in FIG. 12, the drive control substrate 210A includes a control unit 215A, the first drive waveform generation unit (drive waveform generation unit) 212, the second drive waveform generation unit (support piezoelectric element drive waveform generation unit) 214, and a storage unit 216. The control unit 215A includes the first drive control unit (drive control unit) 211 and a second drive control unit (support piezoelectric element drive control unit) 213A.

The droplet ejection head 220A includes the head substrate 221, a piezoelectric element supporting substrate 38, piezoelectric elements 311*a*-311*x*, piezoelectric elements 312*a*-312*x*, and the residual vibration detection substrate 222 as the drive unit.

A residual vibration detection unit 240 is included in the residual vibration detection substrate 222. A waveform processing circuit 250, a switching unit 241, an A/D converter 242, etc., are included in the residual vibration detection unit 240. The waveform processing circuit 250 includes a filter circuit 251, an amplification circuit 252, a peak-hold circuit 253, and the like.

As illustrated in FIG. 7B, the residual pressure vibration occurs in the ink of the pressure chamber 27 after the drive waveform is applied to the drive piezoelectric element 311 (after ink droplet ejection). A residual pressure wave is transmitted from the ink in the pressure chamber 27 to the drive piezoelectric element 311 via the vibration plate 30. The residual vibration caused by the residual pressure wave decays to form a waveform of damped vibration (see "residual vibration waveform emergence period" in FIG. 8 (B)). Consequently, a residual vibration voltage is inducted at the drive piezoelectric element 311 (more specifically, electrode of piezoelectric elements connecting substrate 36)

In FIG. 12, the first drive control unit 211 and the second drive control unit 213A transmit a switching signal to the switching unit 241, where the switching signal is in synchronization with the timing control signal transmitted to the piezoelectric element drive IC 37. Timing for detecting the residual vibration voltage induced at the drive piezoelectric element 311 after the ink droplet ejection by the residual vibration detection unit 240 is controlled by the timing signal.

Upon the residual vibration waveform being input to the residual vibration detection unit 240, a filtering process is performed on the residual vibration waveform by the filter circuit 251 and the residual vibration waveform is amplified by the amplification circuit 252. Further, the peak-hold circuit 253 detects peak amplitude value (e.g., maximum value) of the residual vibration waveform to hold the peak amplitude value.

The switching unit 241 switches connection/disconnection between the drive piezoelectric element 311 and the waveform processing circuit 250. For example, upon the drive piezoelectric element 311 and the waveform processing circuit 250 being connected via the switching unit 241, the voltage induced at the electrode of the piezoelectric elements connecting substrate 36 is applied to the waveform processing circuit 250.

The A/D convertor 242 converts the value of the amplitude values held by the waveform processing circuit 250 into digital data, thereby outputting the digital data to the second drive control unit 213A as residual vibration waveform data. Thus, the residual vibration is fed back.

The second drive control unit 213A calculates a phase information item from the residual vibration waveform data to compare the calculation result with another phase information item stored in the storage unit 216 in advance, thereby correcting the second drive waveform data of the second drive waveform to be applied to the support piezoelectric element 312. Additionally, as illustrated in table 1, a correlation table in which the phase information item of the residual vibration waveform is associated with the second drive waveform may be stored in the storage unit 216, and the second drive waveform to be applied to the support piezoelectric element 312 may be selected with reference to the correlation table.

TABLE 1

| Detected Residual Vibration Waveform | Second Drive Waveform |
|---|---|
| $Vpha_A$ (Leading Phase A) | $Vrev_A$ (Reverse Phase to A) |
| $Vpha_B$ (Leading Phase B) | $Vrev_B$ (Reverse Phase to B) |
| $Vpha_C$ (Reference Phase) | $Vrev_C$ (Reverse Phase to C) |
| $Vpha_D$ (Lagging Phase D) | $Vrev_D$ (Reverse Phase to D) |
| $Vpha_E$ (Lagging Phase E) | $Vrev_E$ (Reverse Phase to E) |

The table 1 is an example correlation table for correcting a shift of the phase in the residual vibration waveform in a case where the second drive waveform has the inverse phase to the phase of the residual vibration waveform. Additionally, this is not a limiting example of phase shift correction. Also, the second waveform may be corrected taking account of amplitude, frequency, etc., of the detected residual vibration in addition to the phase of the residual vibration.

Additionally, in FIG. 12, the residual vibration voltages of the drive piezoelectric elements 311*a*-311*x* are sequentially detected by the residual vibration detection unit (switching unit 241, waveform processing circuit 250, and A/D convertor 242). However, this is not a limiting example. For example, residual vibration detection units corresponding to all of the piezoelectric elements may be provided, and the residual vibration waveforms may be simultaneously detected. Also, the piezoelectric elements may be divided into a plurality of groups, and the residual vibration waveforms may be detected on a group-by-group basis. By dividing the piezoelectric elements into respective groups, increase of circuit scale can be suppressed while number of nozzles whose residual vibration waveforms can be simultaneously detected can be increased.

Figure 13:
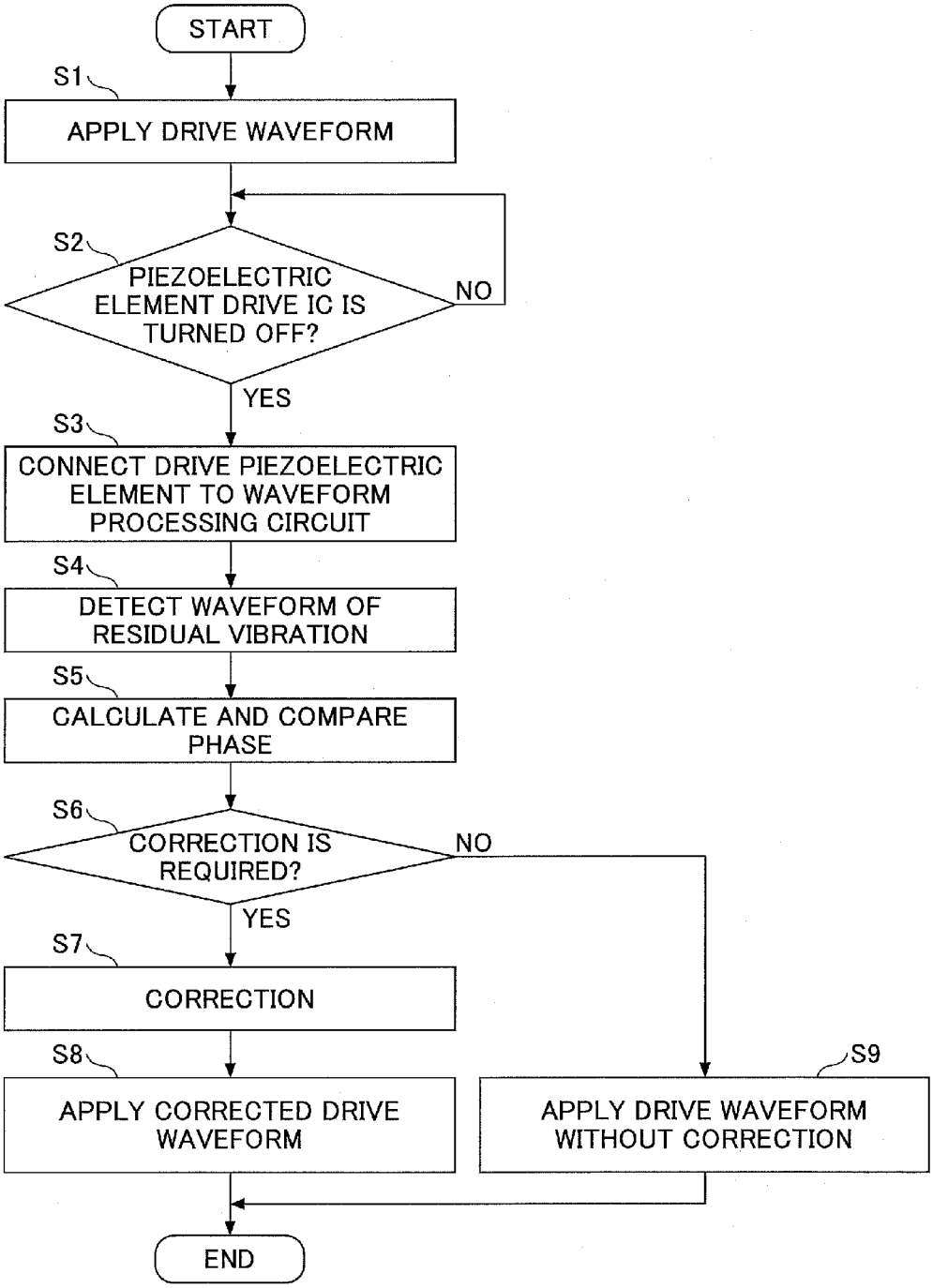
FIG. 13 is a flowchart illustrating an example control in the second embodiment.

FIG. 13 is a flowchart illustrating the control of the second embodiment.

In the following, the control operation of the second embodiment, in which the residual vibration is detected to correct the drive waveform to be applied to the support piezoelectric element 312, will be described with reference to the flowchart.

The drive waveform is applied to the drive piezoelectric element 311 by the first drive waveform generation unit 212 so as to eject the ink (S1).

The first drive control unit 211 monitors the piezoelectric element drive IC 37 to determine whether the piezoelectric element drive IC 37 is turned off (S2).

In a case where the piezoelectric element drive IC 37 is not turned off, the first drive control unit 211 continues to monitor the piezoelectric element drive IC 37 (return to step S1). In a case where the piezoelectric element drive IC 37 is turned off, the drive piezoelectric element 311 and the waveform processing circuit 250 are connected through the switching unit 241, where the residual vibration of the connected drive piezoelectric element 311 is detected (S3).

The residual vibration detection unit 240 detects the residual vibration waveform (detects one vibration of residual vibration caused by a first driving of the drive piezoelectric element 311) (S4).

The second drive control unit 213A calculates the phase of the residual vibration waveform based on the width of the first pulse of the residual vibration waveform, thereby comparing the calculated phase with a reference phase stored in the storage unit 216 in advance (S5).

It is determined whether the correction is required (S6). In a case where it is determined that the correction is required (Yes in S6), a difference between the calculated phase and the reference phase is calculated, and the drive waveform to be applied to the support piezoelectric element is corrected by multiplying the drive waveform by a factor corresponding to the calculated difference (S7).

Figure 14:
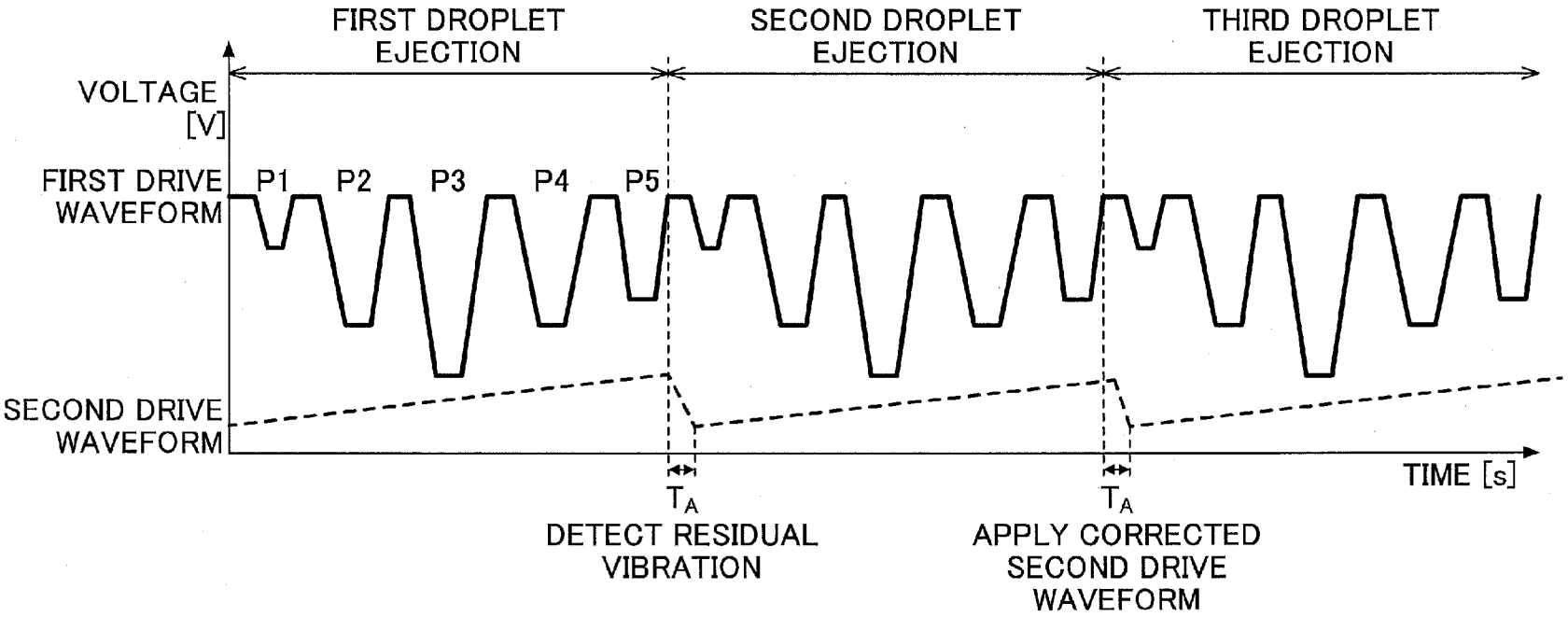
FIG. 14 is a diagram illustrating an example drive waveform of the second embodiment in continuous droplet ejection.

The second drive control unit 213 applies the corrected drive waveform to the support piezoelectric element 312 at next droplet ejection timing, that is, after second driving of the first piezoelectric element 311 (the second driving is performed subsequent to the first driving), as illustrated in FIG. 14 (S8).

In a case where the correction is not required, a predetermined second drive waveform is applied to the support piezoelectric element 312 (S9).

According to the above described process, even if the residual vibration changes, the meniscus vibration (that is residual vibration of liquid) after the ejection of the ink can be more precisely suppressed by driving the support piezoelectric element 312 so as to follow the change of residual vibration.

In the example described above, although the phase is calculated from the width of first pulse of the residual vibration, the phase may be calculated from a pulse other than the first pulse.

According to the embodiment of the present disclosure, the drive waveform corrected based on the phase information of the residual vibration waveform can be applied. Therefore, the residual vibration waveform can be more precisely offset in comparison to a case where the drive waveform in the inverse phase to the phase of the residual vibration waveform of meniscus in the pressure chamber 27 is simply applied to the support piezoelectric element 312.

Herein above, although the present disclosure has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth. The present application claims priority under 35 U.S.C. §119 to Japanese Patent Application No. 2015-129271 filed on Jun. 26, 2015. The contents of which are incorporated herein by reference in their entirety.

What is claimed is:

1. A droplet ejection apparatus comprising:

a droplet ejection head, wherein the droplet ejection head includes a nozzle communicated with a pressure chamber, a first piezoelectric element configured to pressure liquid in the pressure chamber so as to cause a droplet to be ejected, and a second piezoelectric element capable of pressuring the liquid in the pressure chamber;

a first drive waveform generation unit configured to generate a first drive waveform to be applied to the first piezoelectric element;

a second drive waveform generation unit configured to generate a second drive waveform to be applied to the second piezoelectric element; and a control unit configured to apply the second drive waveform to the second piezoelectric element after the first piezoelectric element is driven due to the applied first drive waveform, wherein a residual vibration of the liquid in the pressure chamber is suppressed by a vibration caused by the second piezoelectric element driven in accordance with the second drive waveform, the residual vibration being caused by the first piezoelectric element driven in accordance with the first drive waveform.

2. The droplet ejection apparatus according to claim 1, wherein the first drive waveform includes one or more pulses, and wherein a pulse of the one or more pulses includes at least a first waveform element for contracting the first piezoelectric element to expand the pressure chamber and a second waveform element for expanding the first piezoelectric element to contract the pressure chamber, and wherein the control unit applies the second drive waveform to the second piezoelectric element at a timing that corresponds to ending of the second waveform element.

3. The droplet ejection apparatus according to claim 2, wherein the residual vibration of the liquid in the pressure chamber is caused by repeated contraction and expansion of the liquid, and the second drive waveform is applied at a timing that corresponds to ending of the second waveform element so as to contract the second piezoelectric element to expand the pressure chamber, thereby offsetting a primary contraction among the repeated contraction and expansion in the residual vibration.

4. The droplet ejection apparatus according to claim 1, wherein in response to applying the second drive waveform, the second piezoelectric element vibrates in an inverse phase to a phase of the residual vibration caused by the first piezoelectric element driven in accordance with the first drive waveform.

5. The droplet ejection apparatus according to claim 2, wherein the residual vibration of the liquid in the pressure chamber is caused by repeated contraction and expansion of the liquid, and the second drive waveform is applied at a timing that corresponds to ending of the second waveform element so as to expand the second piezoelectric element to contract the pressure chamber, thereby offsetting the primary contraction among the repeated contraction and expansion in the residual vibration.

6. The droplet ejection apparatus according to claim 1, wherein in response to applying the second drive waveform, the second piezoelectric element vibrates in the same phase as a phase of the residual vibration caused by the first piezoelectric element driven in accordance with the first drive waveform.

7. The droplet ejection apparatus according to claim 1, wherein the second piezoelectric element is disposed adjacent to the first piezoelectric element.

8. The droplet ejection apparatus according to claim 1, wherein the second piezoelectric element is disposed at both sides of the first piezoelectric element.

9. The droplet ejection apparatus according to claim 1, further comprising a residual vibration detection unit configured to detect the residual vibration caused by the first piezoelectric element driven in accordance with the first drive waveform, wherein the control unit corrects the second drive waveform to be applied to the second piezoelectric element based on a phase of the residual vibration detected by the residual vibration detection unit.

10. The droplet ejection apparatus according to claim 9, wherein droplets are ejected a plurality of times, the control unit corrects the second drive waveform based on the phase of the residual vibration caused by a first operation of the first piezoelectric element, and the second drive waveform generation unit applies the second drive waveform corrected by the control unit after a second operation of the first piezoelectric element, the first operation and the second operation being performed in response to the first drive waveform being applied to the first piezoelectric element, the second operation being performed subsequent to the first operation.

11. The droplet ejection apparatus according to claim 1, further comprising a vibration plate, one surface of the vibration plate covering an open end of the pressure chamber, wherein the vibration plate is vibrated by the first piezoelectric element disposed on the other side of the vibration plate to cause a plurality of nozzles to eject droplets, and a plurality of pressure chambers respectively communicated with the plurality of nozzles are formed, the pressure chambers respectively being separated by partition walls, and wherein the second piezoelectric element is disposed at a first position on the other surface of the vibration plate, the first position corresponding to a second position on the one surface of the vibration plate at which a partition wall between the pressure chambers is provided.

12. A method for ejecting a liquid droplet using a droplet ejection head, wherein the droplet ejection head includes a nozzle communicated with a pressure chamber, a first piezoelectric element configured to pressure liquid in the pressure chamber so as to cause a droplet to be ejected, and a second piezoelectric element capable of pressuring the liquid in the pressure chamber, the method comprising:

generating a first drive waveform to be applied to the first piezoelectric element;

generating a second drive waveform to be applied to the second piezoelectric element, wherein a residual vibration of the liquid in the pressure chamber is suppressed by a vibration caused by the second piezoelectric element driven in accordance with the second drive waveform, the residual vibration being caused by the first piezoelectric element driven in accordance with the first drive waveform; and applying the second drive waveform to the second piezoelectric element after the first piezoelectric element is driven due to the applied first drive waveform.

* * * * *